US005148756A

United States Patent [19]

Matysik

[11] Patent Number: 5,148,756

[45] Date of Patent: Sep. 22, 1992

[54] FUEL FEEDER FOR FURNACE

[75] Inventor: Richard C. Matysik, Hunlock Creek, Pa.

[73] Assignee: Geneco Services, Inc., Hunlock Creek, Pa.

[21] Appl. No.: 672,457

[22] Filed: Mar. 20, 1991

[51] Int. Cl.[5] ..... F23K 3/18

[52] U.S. Cl. ..... 110/115; 414/174; 110/101 R; 110/101 CF

[58] Field of Search ..... 110/115, 101 R, 101 CF; 414/174

[56] References Cited

U.S. PATENT DOCUMENTS

| | | | |
|---|---|---|---|
| 2,004,363 | 6/1935 | Beers | 74/40 |
| 2,099,618 | 11/1937 | Olney | 110/115 |
| 2,163,825 | 6/1939 | Bros | 110/115 |
| 2,185,686 | 1/1940 | Bower | 110/115 |
| 2,283,467 | 5/1942 | Scoggin | 236/1 |
| 2,578,161 | 12/1951 | Wagner | 214/18.3 |
| 2,794,406 | 6/1957 | Stark | 110/115 |
| 4,905,613 | 3/1990 | Reschly et al. | 110/105 |

*Primary Examiner*—Henry C. Yuen

*Attorney, Agent, or Firm*—Nies, Kurz, Bergert & Tamburro

[57] ABSTRACT

A chain-type fuel feeder which includes a chain conveyor that deposits coal onto a rotor which then throws the coal into a boiler-type furnace. The conveyor is driven from the shaft of the rotor by way of a novel, variable speed control assembly which includes separate, individual, totally integrated, commercially available drive units mounted on the sidewall of the feeder and exposed to ambient air so as to avoid overheating of the drive components and the problems associated therewith. The various drive components are arranged so that they are readily accessible for adjustment, repair, or replacement.

15 Claims, 4 Drawing Sheets

FUEL FEEDER FOR FURNACE

BACKGROUND OF THE INVENTION

The present invention relates generally to a fuel feeder for a boiler-type furnace and more particularly to a novel speed control drive unit for a chain-type coal feeder for feeding coal into the furnace.

Chain-type feeder units have been used for many years for feeding particulate fuel such as coal to furnaces and operate in such a way as to deliver a uniform sheet of coal onto a rotor which scatters and throws the coal a predetermined distance into the combustion chamber of the furnace. Normally, a number of these feeders are arranged side-by-side across the width of the furnace. One such feeder is shown in U.S. Pat. No. 2,099,618.

Typically, the feeder unit includes a cast iron housing which attaches to a wall of the furnace adjacent a charge opening and houses a chain bar conveyor that feeds coal onto a rotor which throws the coal through the opening into the furnace. The conveyor is driven by a power take-off from the rotor through a variable speed drive mechanism which enables the speed of the conveyor to be adjusted as necessary to deliver selected amounts of fuel to the rotor to compensate for variations in the size, density, and moisture content of the fuel. In the known conventional feeders, the drive transfer components connecting the rotor to the chain conveyor are usually contained in a totally enclosed cast iron casing mounted integrally with one sidewall of the housing where they are exposed to the heat from the sidewall and the furnace. The drive transfer assembly includes many individual customized parts such as gears, lever arms, ratchet and pall mechanisms, clutch mechanisms, etc., all of which are run in an oil bath in the casing in an attempt to maintain the components at a relatively low temperature. While this type of design initially functions fairly well to provide a variable speed drive connection between the rotor and the chain conveyor, problems arise because of the heat buildup within the closed casing. For example, the oil experiences thermal breakdown and the bearings and seals within the drive transfer unit often fail prematurely. In addition, clutch plates become soaked with oil and slip prematurely which cause the chain feeder to interrupt or even stop feeding fuel to the rotor.

Such conventional drive units are not dependable, are difficult and expensive to maintain and have short life, and the feeder units experience substantial downtime. The components are not readily accessible and maintenance personnel consider it a nightmare when attempting to repair the drive transfer unit. In addition, the casing requires substantial machining and thus adds significantly to the cost of the overall housing for the feeder unit.

SUMMARY OF THE INVENTION

Accordingly, the primary object of this invention is to provide a novel chain-type fuel feeder wherein the chain conveyor is driven from the rotor shaft by way of a novel, variable speed control assembly in which the individual drive units are operationally dependable, readily accessible, and easily maintained, thereby reducing maintenance costs and downtime.

Still another object of the invention is to provide the above fuel feeder in which the variable speed control assembly is formed by commercially available, separate, individual, compact, self-contained, totally integrated drive units which cooperate together to provide accurate, adjustable, variable speed control of the chain conveyor to accommodate variations in the condition of the coal delivered to the conveyor and thereby control the amount of coal which must be delivered to the furnace to maintain a desired temperature within the furnace.

A further object of the invention is to provide the above novel chain-type feeder wherein the variable speed control assembly includes a self-contained, variable speed drive unit having its input shaft drive connected to the shaft of the rotor and its output shaft connected to the input shaft of a speed reducer by way of an adjustable torque limiting clutch mechanism. The speed reducer may be a flange mounted or a shaft-mounted type whose output shaft connects directly to the drive shaft of the chain conveyor.

Another object of the invention resides in the provision of the above novel chain feeder unit wherein the various drive components of the variable speed control assembly are mounted on one side wall of the unit fully exposed to the ambient air, the drive components thereby being cooled and maintained within acceptable temperature ranges to avoid overheating of the components and the problems associated therewith.

Still another object of the invention resides in the provision of the above novel fuel feeder wherein the torque limiting clutch mechanism slips at a predetermined torque setting when the feed conveyor jams due to such abnormal conditions as oversized coal, compacted wet coal, a block of iron in the coal, etc. In addition, the control assembly includes an alarm system which is actuated when the torque limiter slips so as to inform the operator of the jammed, no-feed condition of the feed conveyor.

Still another object of the invention resides in the above novel fuel feeder wherein the torque limiter is mounted on the input shaft of the speed reducer, thereby enabling the use of a smaller diameter torque limiter unit and primarily protecting the variable speed drive unit which is more sensitive than the speed reducer to overload conditions.

Other objects and advantages of the invention will become apparent from reading the following detailed description wherein reference is made to the accompanying drawings in which like numerals indicate like elements.

DETAILED DESCRIPTION OF THE INVENTION

Figure 1:
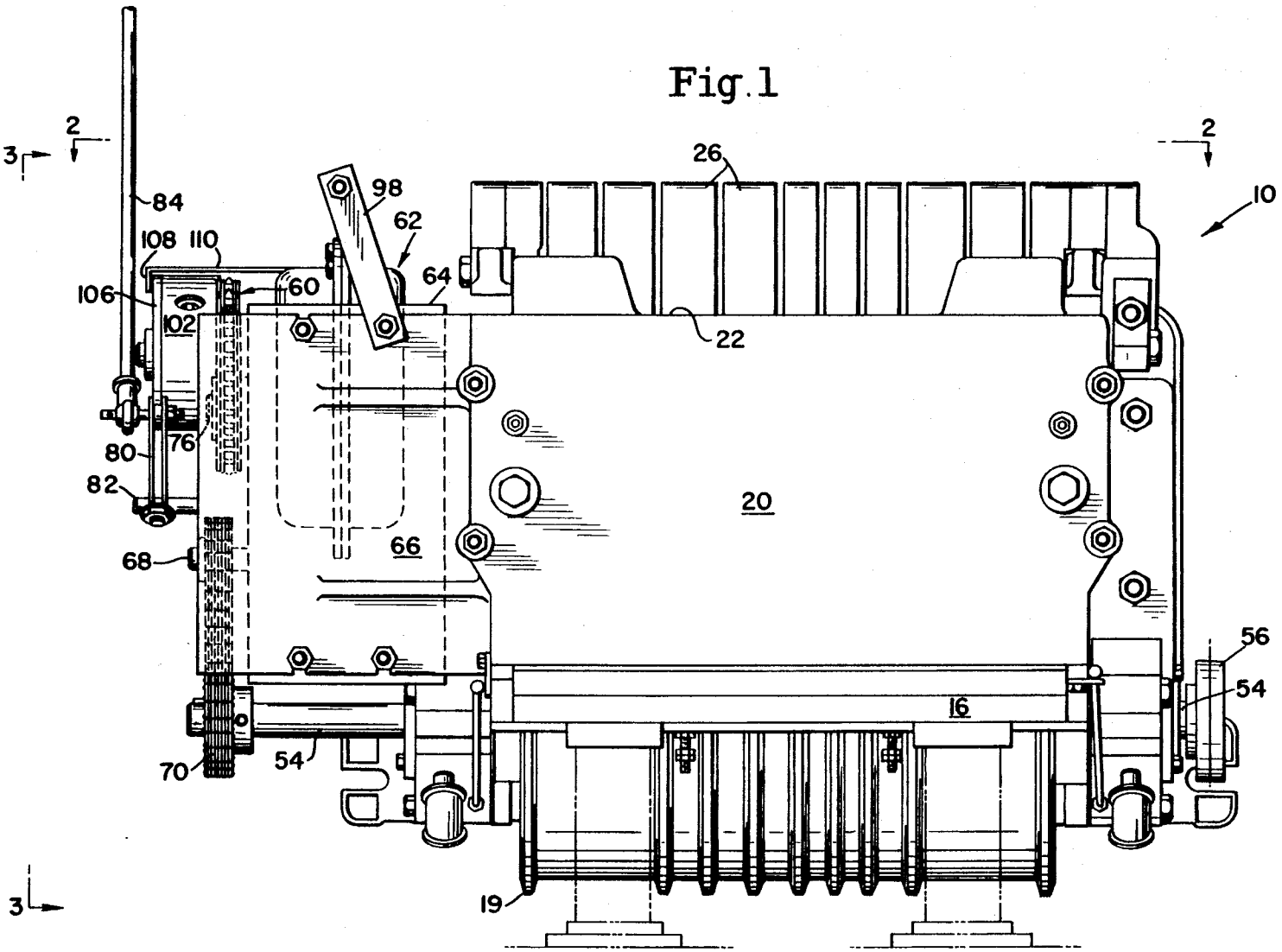
FIG. 1 is a fragmentary rear view of a novel fuel feeder device illustrating in particular the novel, variable speed control assembly mounted on the left side of the feeder unit and connecting the rotor shaft to the chain feeder conveyor.

Referring now to the drawings, the novel fuel feeder device 10 includes a main cast iron housing 11 formed by right sidewall 12, left sidewall 14, bottom wall 16, and front wall 17. A circular rotor chamber 18 is formed by the forward portion of wall 16 and a mating cap 19. The rear of the housing is closed by a back plate 20 bolted onto side plates 12 and 14. Top wall 22 has an enlarged opening 24 at the forward end of which are mounted a plurality of throat blades 26 which are adjustable by the connecting rod and arm assembly 28.

Figure 4:
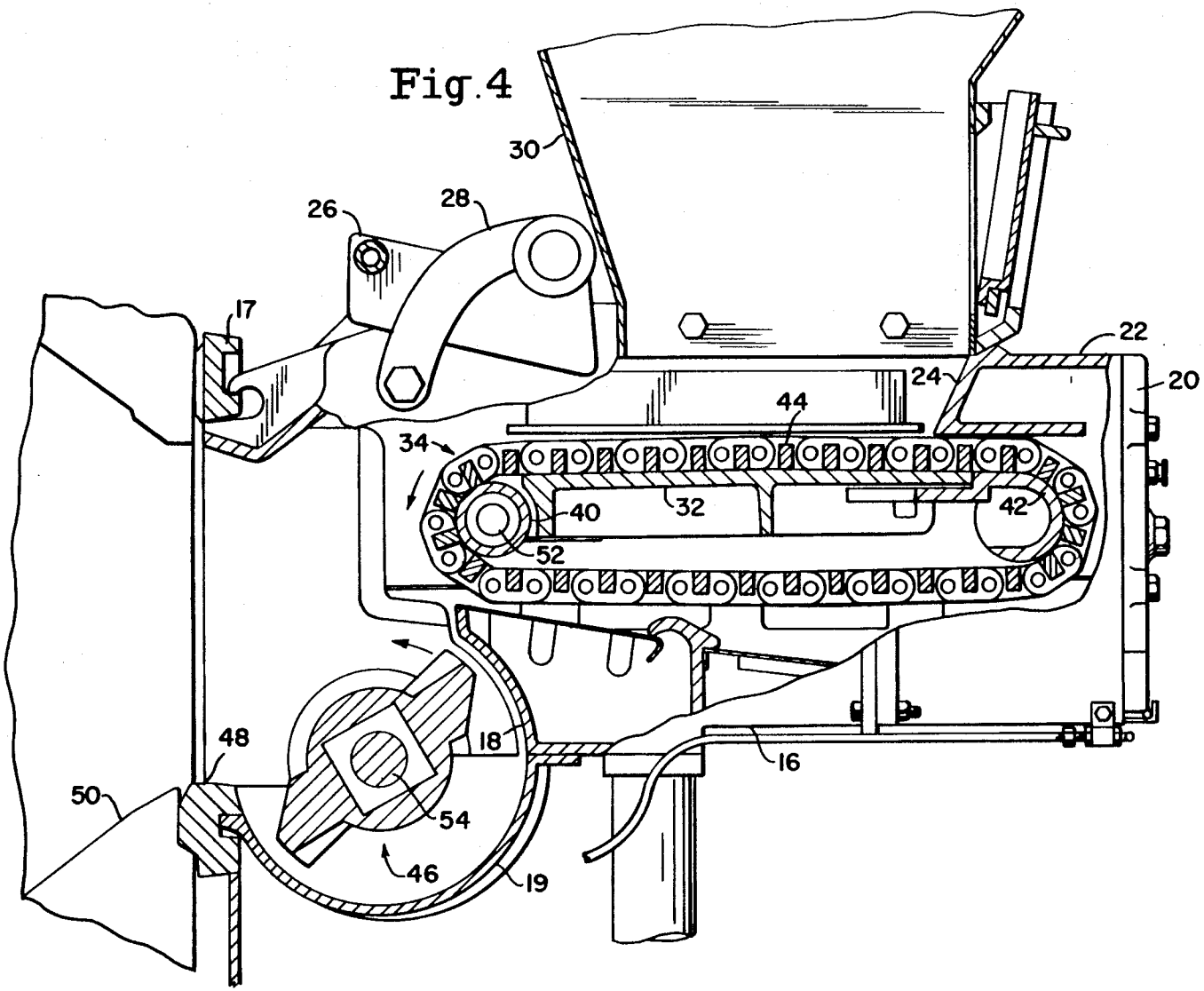
FIG. 4 is a partially sectioned fragmentary view similar to FIG. 3 but illustrating the relationship between the chain conveyor and the rotor within the main housing of the feeder unit.

A hopper 30 fits within opening 24 and receives coal which is then deposited in housing 11 onto a table or spill plate 32 located underneath the upper run of a chain belt bar conveyor 34 formed by laterally spaced chain link sections 36 and 38 mounted on forward drive sprockets 40 and rear follower sprockets 42. Extending between chain link sections 24 and 26 are a plurality of cross bars 44 which drag the coal across spill plate 32 and discharge it off the forward end of conveyor 34 in a continuous stream onto rotor 46 which rotates in a counterclockwise direction as viewed in FIG. 4 to throw the coal through front opening 48 of plate 18 and an aligned charge opening in the wall of furnace 50 into the combustion chamber of the furnace.

Drive sprockets 40 of chain conveyor 34 are mounted on a common shaft 52 rotatably mounted in suitable bearings fixed in side plates 12 and 14. Similarly, rotor 46 is mounted on shaft 54 rotatably mounted in bearings fixed on side plates 12 and 14. The left end of shaft 52 extends outwardly beyond side wall 14, while both ends of shaft 54 extend outwardly beyond sidewalls 12 and 14.

The construction of the feeder device 10 described thus far is conventional and is well-known in the art and need not be described in any further detail.

Figure 2:
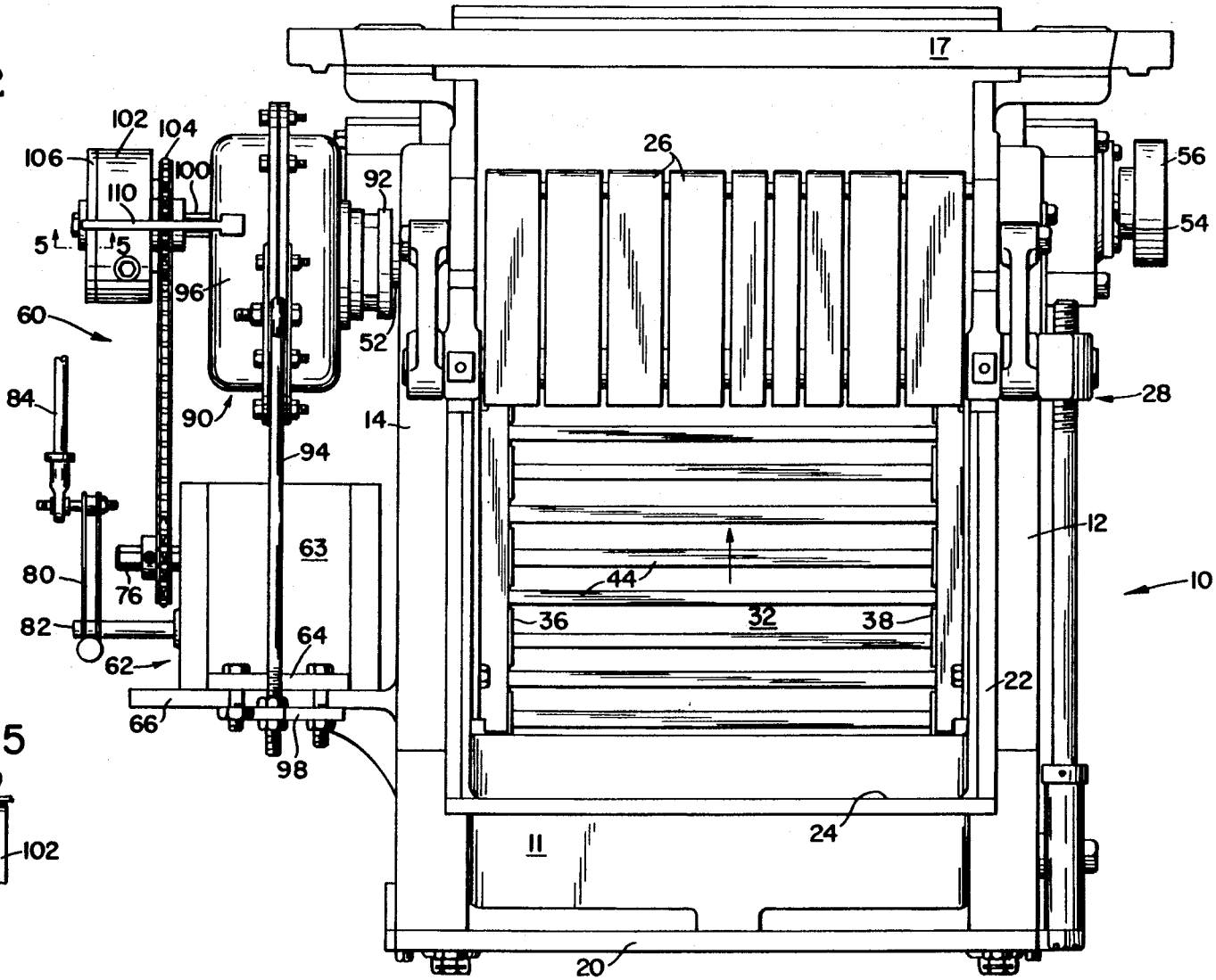
FIG. 2 is a top plan view taken along line 2—2 of FIG. 1.

As seen in FIGS. 1 and 2 of the drawings, a sprocket 56 is mounted o the right end of rotor shaft 54 and is suitably connected to a power source for driving the rotor at a desirable speed of rotation.

As in the conventional feeder unit described initially above, it is desirable that the chain conveyor 34 be driven from the rotor shaft 54 at variable selective speeds to accommodate changes in the condition of the coal, e.g., its size, density, and moisture content, fed to the unit through hopper 30.

To accomplish this in accordance with the invention, applicant provides a novel, variable speed control assembly 60 by which conveyor shaft 52 is driven from rotor shaft 54 at a desired rate of speed. Drive assembly 60 includes a compact, individual, self-contained, totally integrated, adjustable speed drive unit 62 having a housing 63 and a base plate 64 mounted on a support arm 66 which is cast integrally with side plate 14. In a prototype of the invention, unit 62 was a readily commercially available Zero-Max® mechanical adjustable speed drive unit, Model ZX41, having an output speed range of 0–400 RPM and an output torque rating of 200-inch pounds. Unit 62 has an input shaft 68 which is drive connected to rotor shaft 54 by way of a chain drive 70 riding on sprockets 72 and 74. Unit 62 also has an output shaft 76 on which sprocket 78 is mounted. The RPM speed within the range of 0–400 RPM of output shaft 76 is controlled by lever 80 mounted on rotatable control shaft 82 and actuated by an operator via rod 84, the position of which is essentially the same as the actuating rod in the conventional feeder units described hereinabove so that applicant's novel feeder unit may readily replace conventional feeders without requiring any changes in installation procedures in the field.

Figure 3:
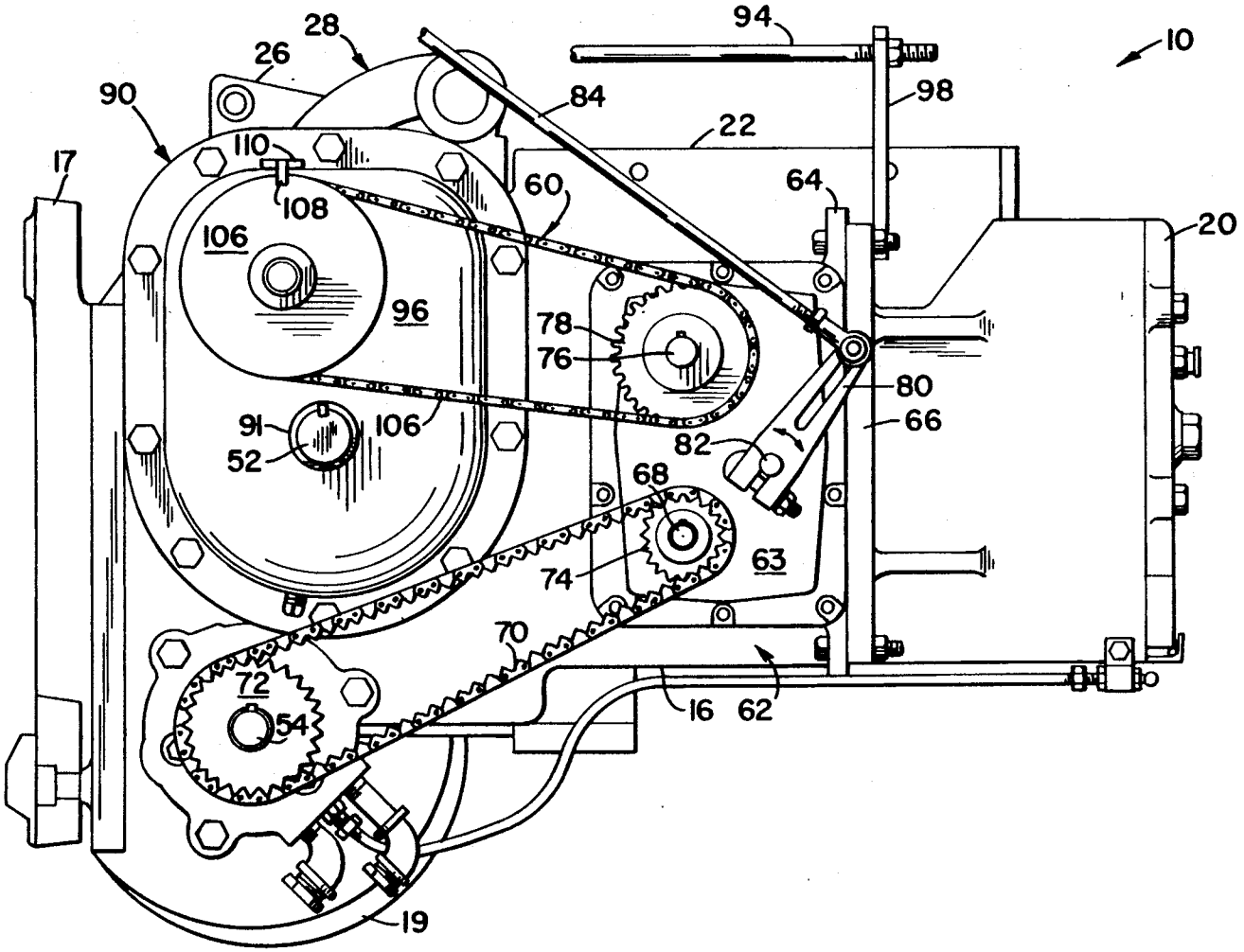
FIG. 3 is a left side elevation view taken along line 3—3 of FIG. 1 illustrating the variable speed control assembly.

Drive assembly 60 also includes an individual, compact, self-contained, totally integrated, shaft mounted speed reducer 90 which is readily commercially available and may be of the type such as a Morse speed reducer, Model 115XM25, having a speed reduction ratio of approximately 25:1. This type of reducer has a hollow output shaft 91 which mounts directly on conveyor shaft 52 and is retained thereon in standard fashion by a standard taper-lock bushing 92. Similarly, in standard fashion, reducer 90 is held stationary by torque arm 94 secured between housing 96 of reducer 90 and metal strip 98 which is fastened to support arm 66 (see FIGS. 1–3).

Reducer 90 has an input shaft 100 on which is mounted a variable torque limiting clutch mechanism 102 of the type which is readily commercially available such as a Morse Torq-GARD-® clutch, Model TG60. Clutch unit 102 includes a hub-mounted sprocket 104 which is drive connected by a chain 106 to sprocket 78 on output shaft 76 of adjustable speed unit 62. In this fashion, the drive output from shaft 76 of unit 62 is transferred to sprocket 104 through clutch 102 to input shaft 100 of reducer 90, and thence to conveyor shaft 52 through operation of reducer 90.

Figure 5:
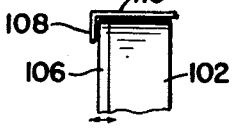
FIG. 5 is a fragmentary, sectional view taken along line 5—5 of FIG. 2, illustrating the position of the alarm switch relative to the clutch plate.

Torque limiting clutch unit 102 may be set at a predetermined torque level to interrupt the drive connection between sprocket 104 and shaft 100 should conveyor 34 become abnormally overloaded or jammed up and thereby stop feeding coal to rotor 46. When this occurs, the end clutch plate 106 of limiter 102 is displaced axially outwardly as shown in FIGS. 2 and 5 and strikes limit switch 108 mounted on arm 110 which is suitably supported from some convenient location on feeder unit 10. When this occurs an alarm is sounded to inform the operator that the unit 10 is jammed up and requires service.

As torque limiter 102 slips or disengages under an overload condition, the various drive components and their shafts are automatically protected against breakage. When the overload condition is resolved, feeder unit 10 then quickly resumes its normal running operation with no damage having been done to its drive components.

It is significant that the torque limiter 102 is mounted on the input shaft 100 of reducer 90 rather than on the output thereof. This enables the use of a smaller diameter torque limiter and provides direct protection to adjustable speed drive unit 62 which is more sensitive to torque overload than is reducer 90.

Further, the particular arrangement of units 62, 90, and 102 and the manner in which they are supported with respect to side wall 14 is significant. Because the cast iron housing 11 is bolted directly up against the wall of furnace 50, sidewall 14 is very hot in normal operation. As seen in FIGS. 1 and 2, applicant has advantageously mounted speed unit 62 and reducer 90 in open, spaced relationship from wall 14 so that ambient air freely circulates around the drive assembly 60 and its various components to provide a cooling affect on those components, thereby avoid premature damage or failure due to heat buildup.

It is also significant that torque limiter 102 and the connecting chain drive coupling assemblies are mounted on the outside of units 62 and 90 where they ar readily accessible for adjustment, repair, or replacement.

The size of sprockets 72, 74, 78, and 104 may be suitably selected to provide a desired speed range of conveyor 34 at a particular installation. Similarly, the operating parameters of adjustable speed unit 62 and reducer 90 may be selected to accommodate conditions at a particular installation.

It is thus apparent that the novel feeder unit 10 of the invention provides a novel, dependable, economical, variable speed drive transfer assembly 60 from rotor shaft 54 to conveyor shaft 52 constructed of commercially available, compact, self-contained, individual drive components arranged and coupled together so as to be quickly and easily assembled, and to provide desired operating characteristics of chain conveyor 34 feeding coal to rotor 46. The compact, individual, self-contained units 62 and 90 and torque limiter 102 are arranged in such a way with respect to side wall 14 so that the components are cooled by ambient air during operation of the feeder unit and so that the various drive elements are readily accessible for repair or replacement by an operator in the field should the need arise. Furthermore, the simple, compact, totally integrated assembly reduces cost of the total feeder unit by eliminating the many custom made parts associated with prior conventional feeder units, by eliminating operational and repair problems associated with those prior conventional units due to heat build up and oil soaking within those parts, and by avoiding the nightmarish experiences encountered in attempting to repair or replace those parts in the field when necessary.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A feeder for feeding particulate fuel into a furnace comprising a housing having side walls, top and bottom walls, and a front wall having a discharge opening adapted to align with a charge opening in a wall of the furnace, said top wall having a fuel inlet opening for receiving fuel into said housing, rotor means adjacent said discharge opening including a rotor shaft with ends rotatably mounted on and extending beyond said side walls of said housing, fuel conveying means mounted in said housing to receive fuel from said inlet opening and to convey said fuel to said rotor means which then throws said fuel through said discharge opening into the furnace, power means connected to one end of said rotor shaft for rotating said rotor means, a variable speed drive assembly connecting the other end of said rotor shaft to said conveying means, said drive assembly including a self-contained adjustable speed drive unit having an input shaft, an output shaft, and adjusting means for regulating the speed of said output shaft, means mounting said adjustable speed unit from one wall of said housing, first drive means connecting the other end of said rotor shaft to said input shaft of said adjustable speed drive unit, a conveyor shaft rotatably mounted on said one wall of said housing and drive connected to said fuel conveying means, a self-contained speed reducer having an input shaft and a output shaft connected to said conveyor shaft, adjustable torque limiting means mounted on the input shaft of said speed reducer, and second drive means connecting said torque limiting means to said output shaft of said adjustable speed drive unit.

2. The feeder according to claim 1, wherein said adjustable speed drive unit and said speed reducer are exposed to ambient air.

3. The feeder according to claim 2, wherein said adjustable speed drive unit and said speed reducer are mounted in spaced relationship from one sidewall of said housing.

4. The feeder according to claim 3, wherein said torque limiting means and said first and second drive means are mounted axially outwardly of said adjustable speed drive unit and said speed reducer where they are readily accessible for adjustment, repair, or replacement.

5. The feeder according to claim 1, comprising alarm means responsive to an overload on said torque limiting means to indicate an abnormal condition of said fuel conveying means.

6. The feeder according to claim 1, wherein the output speed of said adjustable speed drive unit may be varied from 0 to some maximum RPM.

7. The feeder according to claim 1, wherein said speed reducer is a shaft-mounted type having a hollow output shaft mounted directly on said conveyor shaft.

8. A feeder for feeding particulate fuel into a furnace comprising a housing having sidewalls, top and bottom walls, and a front wall having a discharge opening adapted to align with a charge opening in a wall of the furnace, said top wall having a fuel inlet opening for receiving fuel into said housing, rotor means adjacent said discharge opening including a rotor shaft with ends rotatably mounted on and extending beyond said side walls, fuel conveying means mounted in said housing to receive fuel from said inlet opening and to convey said fuel to said rotor means which then throws said fuel through said discharge opening into the furnace, power means connected to one end of said rotor shaft for rotating said rotor means, a variable speed drive assembly connecting the other end of said rotor shaft to said conveying means, said drive assembly including a self-contained adjustable speed drive unit having an input shaft, an output shaft, and adjusting means for regulating the speed of said outlet shaft, means mounting said adjustable speed drive unit from one side wall of said housing, first drive means connecting said other end of said rotor shaft to said input shaft of said adjustable speed drive unit, said conveyor means including a rotatable shaft extending outwardly beyond said one sidewall of said housing, a self-contained shaft-mounted speed reducer having an input shaft and a hollow output shaft mounted on said conveyor shaft, adjustable torque limiting means mounted on said input shaft of said speed reducer, second drive means connecting said torque limiting mean to said output shaft of said adjustable speed unit, said adjustable speed unit and said speed reducer being mounted in spaced relationship from said one sidewall and being exposed to ambient air, and said torque limiting means and said first and second drive means being mounted axially outwardly of said adjustable speed drive unit and said speed reducer where they are readily accessible for adjustment, repair, or replacement.

9. A feeder according to claim 8 comprising alarm means responsive to an overload on said torque limiting means to indicate an abnormal condition of said fuel conveying means.

10. A feeder in accordance with claim 8 wherein said fuel conveying means is a continuous chain-type conveyor.

11. The feeder in accordance with claim 8 wherein the output speed of said adjustable speed drive unit may be varied from 0 to some maximum RPM.

12. A feeder for feeding particulate fuel into a furnace comprising a housing having side walls, top and bottom walls, and a front wall having a discharge opening adapted to align with a charge opening in a wall of the furnace, said top wall having a fuel inlet opening for receiving fuel into said housing, rotor means adjacent said discharge opening including a rotor shaft with ends rotatably mounted on said side walls of said housing, fuel conveying means mounted in said housing to receive fuel from said inlet opening and to convey said fuel to said rotor means which then throws said fuel through said discharge opening into the furnace, power means connected to said rotor shaft for rotating said rotor means, a variable speed drive assembly connected one end of said rotor shaft to said conveying means, said drive assembly including a self-contained adjustable speed drive unit having an input shaft, an output shaft, and adjusting means for regulating the speed of said output shaft, means mounting said adjustable speed unit from one wall of said housing, first drive means connecting said one end of said rotor shaft to said input shaft of said adjustable speed drive unit, a conveyor shaft rotatably mounted on said one wall of said housing and drive connected to said fuel conveying means, a self-contained speed reducer separate from said adjustable speed drive unit, said speed reducer having an input shaft and an output shaft connected to said conveyor shaft, adjustable torque limiting means mounted on the input shaft of said speed reducer, and second drive means connected said torque limiting means to said output shaft of said adjustable speed drive unit.

13. The feeder according to claim 12, wherein said adjustable speed drive unit and said speed reducer are mounted in spaced relationship from one sidewall of said housing.

14. The feeder according to claim 13, wherein said torque limiting means and said first and second drive means are mounted axially outwardly of said adjustable speed drive unit and said speed reducer where they are readily accessible for adjustment, repair, or replacement.

15. The feeder according to claim 12, wherein said speed reducer is a shaft-mounted type having a hollow output shaft mounted directly on said conveyor shaft.

* * * * *

UNITED STATES PATENT AND TRADEMARK OFFICE

CERTIFICATE OF CORRECTION

PATENT NO. : 5,148,756

DATED : September 22, 1992

INVENTOR(S) : Richard C. Matysik

It is certified that error appears in the above-identified patent and that said Letters Patent is hereby corrected as shown below:

Column 7, line 22 -- change "connected" to "connecting."

Column 8, line 11 -- change "connected" to "connecting."

Signed and Sealed this

Seventh Day of September, 1993

Bruce Lehman

*Attest:*

BRUCE LEHMAN

*Attesting Officer*

*Commissioner of Patents and Trademarks*